US007270054B2

(12) United States Patent
Bobren et al.

(10) Patent No.: US 7,270,054 B2
(45) Date of Patent: Sep. 18, 2007

(54) INTEGRATED PACKAGE PACER FOR STRAPPING MACHINE

(75) Inventors: Allan J. Bobren, Streamwood, IL (US); Timothy B. Pearson, Antioch, IL (US); Lawrence G. Sickels, Spring Grove, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/306,981

(22) Filed: Jan. 18, 2006

(65) Prior Publication Data

US 2007/0163452 A1 Jul. 19, 2007

(51) Int. Cl.
*B65B 13/00* (2006.01)
*B65B 13/04* (2006.01)
*B65G 47/29* (2006.01)

(52) U.S. Cl. ..... 100/26; 100/7; 100/18; 53/589; 198/459.6

(58) Field of Classification Search ..... 100/7, 100/8, 18, 25, 26, 29; 53/589, 590; 198/459.6, 198/782
See application file for complete search history.

(56) References Cited

U.S. PATENT DOCUMENTS 2,636,654 A * 4/1953 Sykes ..... 53/389.3
4,622,893 A * 11/1986 Magoni et al. ..... 100/2
4,721,038 A * 1/1988 Eldridge ..... 100/8
6,502,373 B1 * 1/2003 Tipton et al. ..... 53/504
2003/0173187 A1 * 9/2003 Johnson et al. ..... 198/459.6

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

A package pacer is configured for use with an automatic strapping machine having a strap chute through which strap material is fed and from which strap material is tensioned onto a package. The strapping machine has an in-feed conveyor defining a plane and is configured to automatically move a package into a packaging region bounded by the chute. The pacer includes a frame that is mountable to the strapping machine. A plurality of rollers are mounted to the frame in a stationary plane about coplanar with the in-feed conveyor plane. The rollers extend forwardly of the strapping machine and permit conveyance of the package therealong and onto the in-feed conveyor. A pacing element is movable between a stop position in which the pacer element is out of the in-feed conveyor plane and interferes with movement of the package onto the in-feed conveyor and a feed position in which the pacing element resides about coplanar with the planar stationary rollers and the in-feed conveyor. A drive moves the pacing element between the stop position and the feed position.

11 Claims, 5 Drawing Sheets

INTEGRATED PACKAGE PACER FOR STRAPPING MACHINE

BACKGROUND OF THE INVENTION

The present invention is directed to an improved feed system for a strapping machine. More particularly, the present invention is directed to a pacer that prevents overfeeding packages into a strapping machine.

Strapping machines are in widespread use for securing straps around loads. Strappers are often used in production lines that operate at relatively high speeds. These lines are for the most part automated, however, operators are generally required at certain points along the line, including at the infeed to the strapper.

At times these lines operate at speeds that are greater than those that the strapper can accommodate. To maintain line speeds, operators may be inclined to move packages into the strapper at a rate greater than that for which the strapper is designed. This can result in packages being conveying into the strapper prior to the strapping cycle for a previous package being completed.

When packages are fed too quickly into a strapper, a number of problems can occur. First, the previous or prior package could be improperly or incompletely strapped. This is turn could result in damage to the package and/or contents, product returns and the like.

While improper or incomplete strapping can compromise the integrity of a package, a more significant problem is the potential to misfeed or jam strap which could result in having to stop the strapping operation, possibly halting the production line.

Accordingly, there is a need for a pacer that limits the rate at which packages are fed into the strapper. Desirably, such a pacer provides a physical stop of the packages to prevent overloading the packages in the strapper. More desirably, such a pacer is automated so that the sensing of the presence or absence of a package functions to permit or prevent movement of packages into the strapper.

BRIEF SUMMARY OF THE INVENTION

A package pacer is configured for use with an automatic strapping machine. The pacer provides a physical stop of packages to prevent overloading the packages in the strapper. Such a pacer is automated so that the sensing of the presence or absence of a package functions to permit or prevent movement of packages into the strapper.

The strapping machine with which the pacer is used has a strap chute through which strap material is fed and from which strap material is tensioned onto the package. The strapping machine has an in-feed conveyor that defines a plane and is configured to automatically move the package into a packaging region bounded by the chute.

The pacer includes a frame that is mounted to the strapping machine. A plurality of rollers is mounted to the frame in a stationary plane about coplanar with the in-feed conveyor plane. The rollers extend forwardly of the strapping machine and are configured to permit conveying the package therealong and onto the in-feed conveyor.

A pacing element is movable between a stop position and a feed position. In the stop position, the pacer element is out of the in-feed conveyor plane and interferes with movement of the package onto the conveyor. In the feed position, the pacing element resides about coplanar with the planar stationary rollers and the in-feed conveyor to permit feed into the strapper. Preferably, the pacing element is a roller.

The pacer includes means for moving the pacing roller between the stop position and the feed position. In a present embodiment, the pacing roller is mounted to a carrier (that is mounted to the pacer frame) and is configured to move the pacing roller between the stop position and the feed position.

The carrier can be pivotally mounted to the frame and is driven by a reciprocating element such as a cylinder.

A sensor can be operably connected to the moving cylinder to sense the presence or absence of a package to generate a signal to actuate the cylinder to move the pacing roller between the stop position and the feed position.

These and other features and advantages of the present invention will be apparent from the following detailed description and drawings in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 1:
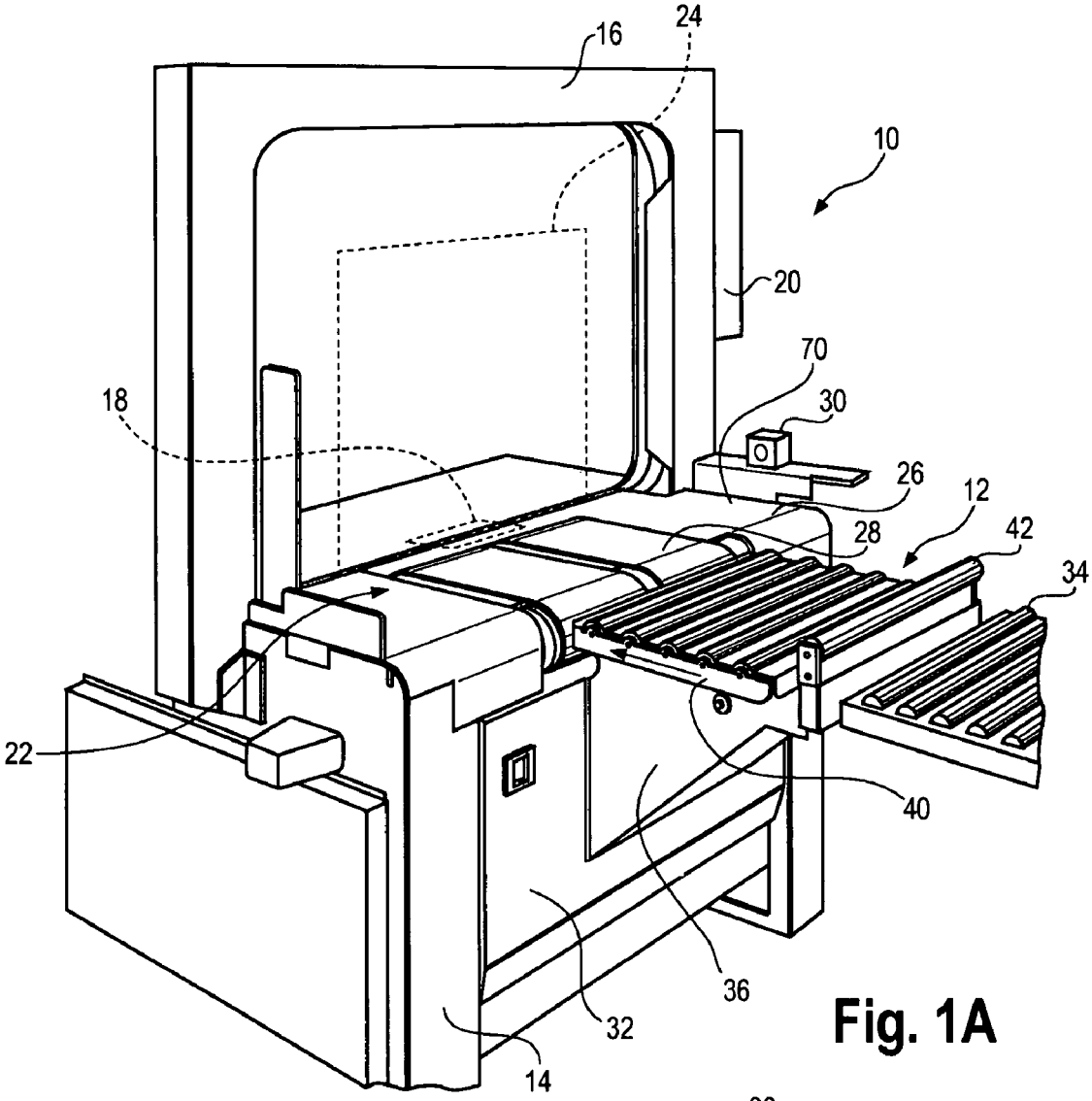
FIG. 1 is a perspective view of strapping machine having an infeed roller set and an infeed package pacer embodying the principles of the present invention, the pacer being shown in the stop position.

Referring to the figures and in particular to FIG. 1, there is shown a strapping machine 10 having an integrated infeed package pacer 12 embodying the principles of the present invention. The strapping machine 10 shown is of a known type, such as the LBX-2300 Automatic Strapping Machine commercially available from ITW Signode of Glenview, Ill.

The strapping machine 10 includes generally, a frame 14, a strap chute 16, a strapping head 18, a strap supply or dispenser (not shown) and a control system 20. A work surface 22 is defined at the area within the chute 16 at which the strapping operation occurs (the strapping area, as indicated generally at 24)). The surface 22 can be formed as a portion of the chute 16 and can include one or more "hard" table-top like surfaces 26. The strapper 10 further includes an infeed conveyor 28, such as the illustrated belt-type conveyor. The conveyor 28 is configured to feed a load (such as a package) into the strapping area 24 for the strapping operation to occur. In such an arrangement, one or more sensors 30 can be positioned to determine the presence or absence of a package in the strapping area 24.

The pacer 12 is mounted to the front 32 of the strapper 10, and essentially forms an integrated part of (or is integral with) the strapper 10. The pacer 12 forms an entrance to the strapper 10 and, when used in an arrangement with the feed conveyor 28, forms a bridge between the conveyor 28 and an upstream product feed or conveyor system, a portion of which is indicated at 34.

The pacer 12 includes a frame 36 having a plurality of roller elements 38 mounted thereto to define a stationary planar conveying path 40. The path 40 aligns with (is substantially coplanar with) the strapper belt conveyor 28 and the product conveyor system 34.

Figure 1A:
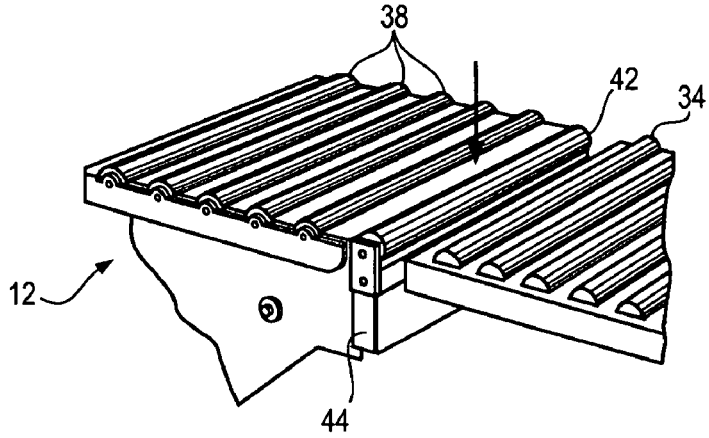
FIG. 1A is a partial perspective view of the pacer in the feed position.
Figure 2:
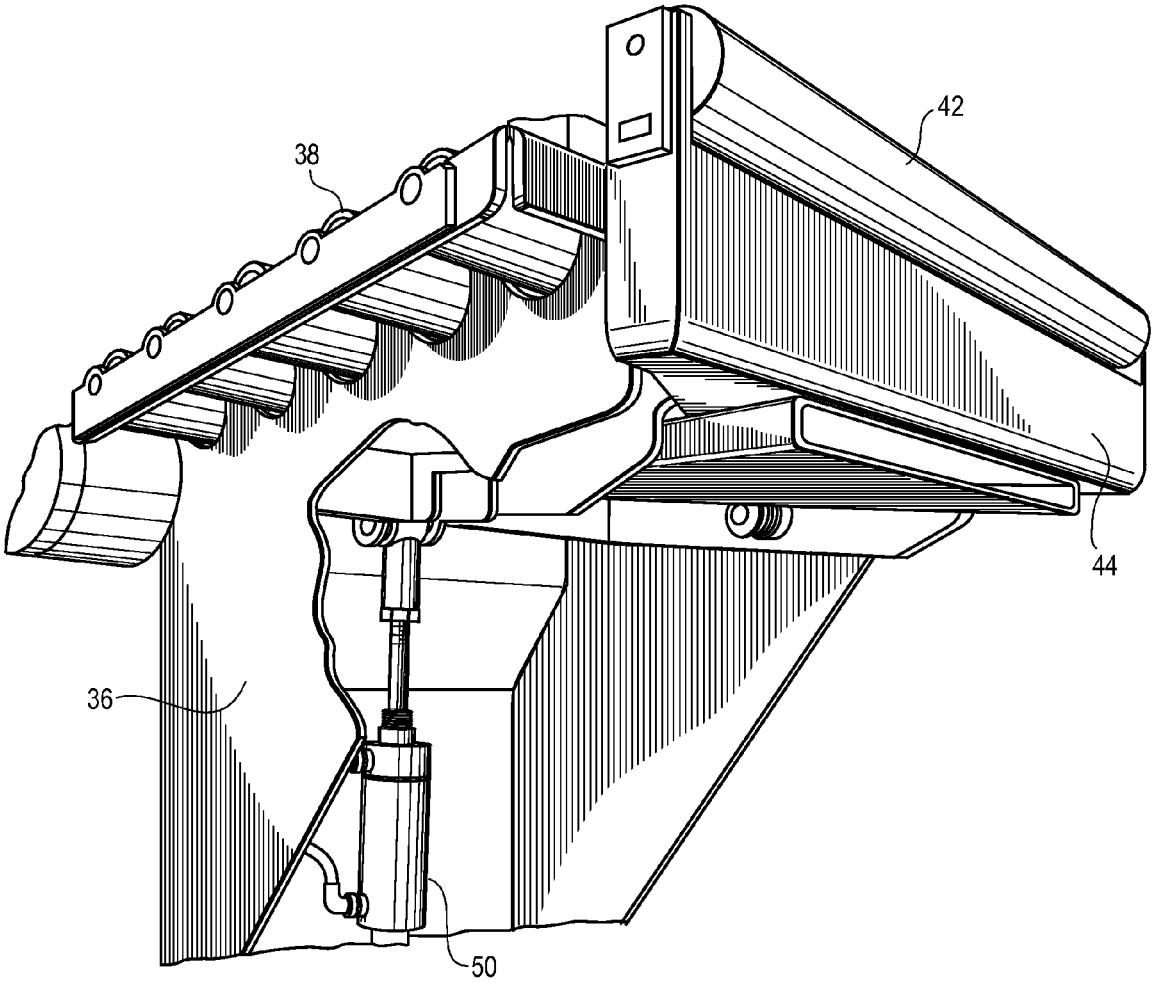
FIG. 2 is a bottom partial perspective view of the pacer showing the pacer actuator.
Figure 3:
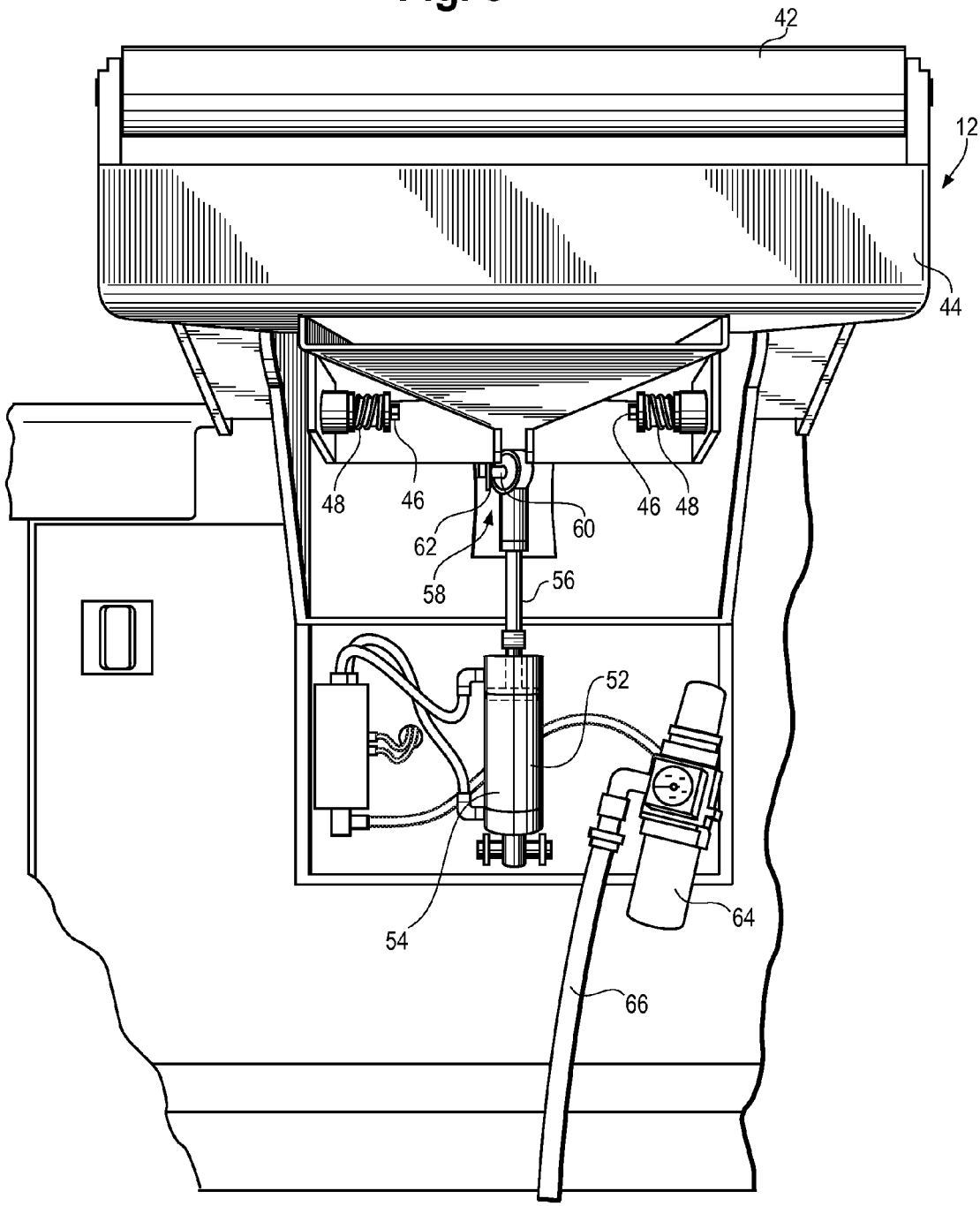
FIG. 3 front view of the pacer showing the actuator and pivot frame.
Figure 4:
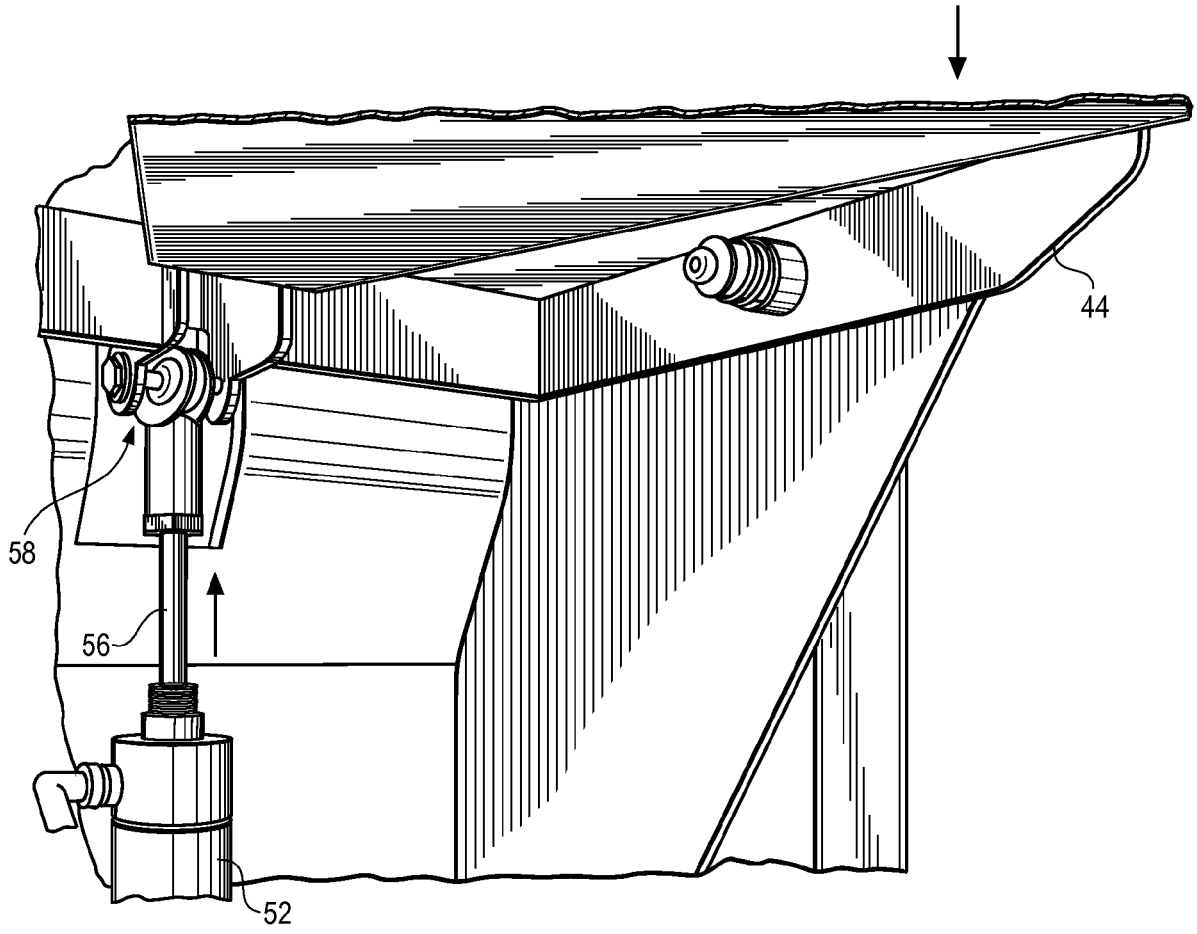
FIG. 4 is a partial perspective view similar to FIG. 2 showing the actuator (extending) moving to the feed position and the pacer plate pivoting downward, again to the feed position.
Figure 5:
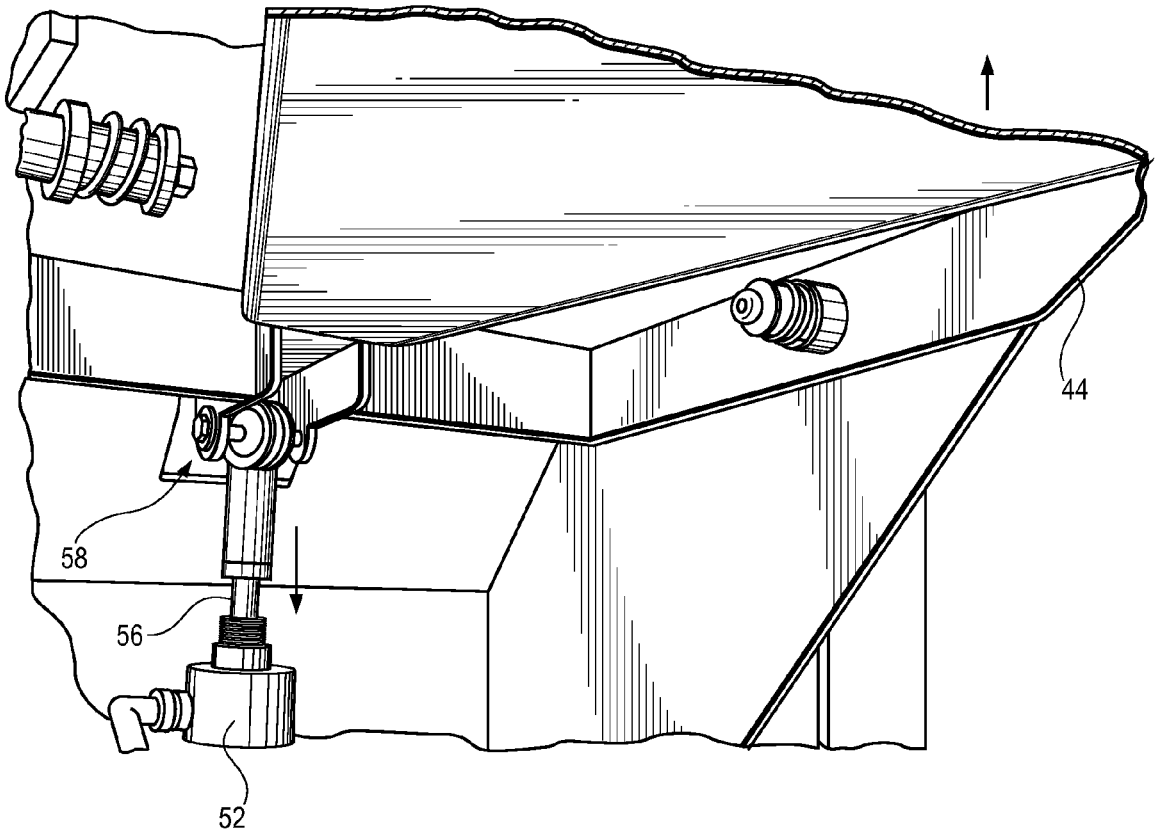
FIG. 5 is a partial perspective view similar to FIGS. 2 and 4, but showing the actuator (retracting) moving to the stop position and the pacer plate pivoting upward, again to the stop position.

The pacer 12 includes a pacing roller element 42 that is mounted to a pivotal carriage 44. The carriage 44 pivots between a first position or feed position (FIG. 1A) in which the pacing roller element 42 is about coplanar with the path 40 and a second or stop position (FIG. 1) in which the pacing roller 42 is moved up, above and out of the path 40. In the feed position a package moving along the product conveyor 34 will roll over the pacing roller 42 and into the strapper 10. In the stop position, the carriage 44 pivots to move the pacing roller 42 up into the conveyor path 40, to stop the package from entering the strapper 10.

In a present pacer system 12, the pivotal carriage 44 is mounted to the pacer frame 36 by pivot pins 46. The pins 46 are mounted by springs 48 so that the pivotal carriage 44 can move slightly side-to-side to accommodate any forces that may be exerted on the pacing roller 42 (for example, when a package is on the pacer 12), and maintain the pins 46 in place.

The pacer 12 includes a drive 50 to pivot the carriage 44. In a present system, the drive 50 is a pneumatic cylinder 52. The cylinder 52 includes a body 54 and a reciprocating rod 56. The rod 56 is mounted to the carriage 44 by a universal-type joint 58 (e.g., an eye 60 portion on the rod 56 and a pin 62 traversing the eye 60 and carriage 44) to permit the carriage 44 to freely move as the cylinder 52 reciprocates.

The pneumatic system 64 is supplied by an air supply 66 and is controlled by the overall machine controller 20. The sensor 30 (or more than one sensor) is mounted to the machine 10 to determine the presence or absence of a package in the strapping area 24 and in the preparation area 70 just upstream from the strapping area 24. In this manner, the sensor 30 can be used to send a signal to the machine controller 20 to actuate the cylinder 52 to move the carriage 44 (and thus the pacer roller 42 into the feed or stop positions). This can be coordinated or indexed with the overall machine 10 operation.

In an anticipated operating scheme, as a package is present in the strapping area 24, a second package is on the stationary pacer roller elements 38 and the strapper conveyor 28 (e.g., in the preparation area 70), ready to be moved into the strapping area 24. In this condition, the sensor 30 senses the presence of a package in the preparation area 70 and the pacer roller 42 is in the stop position to prevent any upstream packages from moving into the strapper 10.

When the strapping operation is complete, the strapping machine conveyor 28 starts which moves the package in the strapping area 24 out of the strapping area 24 and moves the second package (in the preparation area 70) into the strapping area 24. As the second package moves passed the sensor 30, the sensor 30 senses the absence of a package in the strapping area 24 and the pneumatic cylinder 52 is actuated to move the pacer element 24 into the feed position. As this occurs, the packages on the product conveyor 34 all move toward the strapper 10 and a subsequent package moves into the preparation area 70. The sensor 30 senses the presence of a package in the preparation area 70 and a signal is sent to the pneumatic actuator 52 to move the pacer element 42 into the stop position. This completes one cycle.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A package pacer for use with an automatic strapping machine, the strapping machine having a strap chute through which strap material is fed and from which strap material is tensioned onto a package, the strapping machine having an in-feed belt conveyor defining an in-feed conveyor plane and configured to automatically move a package into a packaging region bounded by the chute, the pacer comprising:

a frame, the frame mountable to the strapping machine;

a plurality of rollers mounted to the frame in a stationary plane about coplanar with the in-feed conveyor plane, the rollers extending forwardly of the strapping machine, the rollers configured to permit conveyance of the package therealong and onto the in-feed conveyor;

a pacing element movable between a stop position in which the pacer element is out of the in-feed conveyor plane and interferes with movement of the package onto the plurality of rollers and the in-feed conveyor and a feed position in which the pacing element resides about coplanar with the plurality of rollers and the in-feed conveyor, wherein the pacing element is mounted to a pacing element carriage, the pacing element carriage being pivotally spring mounted to the frame by a plurality of pins and springs, each of the pins is connected to the respective spring such that the pacing element carriage can move side to side within the frame; and means for moving the pacing element between the stop position and the feed position, wherein the means for moving the pacing element is mounted to the pacing element carriage by a universal joint.

2. The package pacer in accordance with claim 1 wherein the pacing element is a roller.

3. The package pacer in accordance with claim 1 including a pacing element carriage mounted to pacer frame and configured to move the pacing element between the stop position and the feed position.

4. The package pacer in accordance with claim 1 wherein the means for moving the pacing element is a reciprocating cylinder.

5. The package pacer in accordance with claim 4 wherein the cylinder is a pneumatic cylinder.

6. The package pacer in accordance with claim 1 including a sensor operably connected to the moving means to sense the presence or absence of a package to generate a signal to move the pacing element between the stop position and the feed position.

7. A package pacer for use with an automatic strapping machine, the strapping machine having a strap chute through which strap material is fed and from which strap material is tensioned onto a package, the strapping machine having an in-feed belt conveyor defining an in-feed conveyor plane and configured to automatically move a package into a packaging region bounded by the chute, the pacer comprising:

a frame, the frame mountable to the strapping machine;

a plurality of rollers mounted to the frame in a stationary plane about coplanar with the in-feed conveyor plane, the rollers extending forwardly of the strapping machine, the rollers configured to permit conveyance of the package therealong and onto the in-feed conveyor;

a pacing roller movable between a stop position in which the pacer roller is out of the in-feed conveyor plane and interferes with movement of the package onto the plurality of rollers and the in-feed conveyor and a feed position in which the pacing roller resides about coplanar with the plurality of rollers and the in-feed conveyor;

a pacing roller carriage pivotally spring mounted to pacer frame by a plurality of pins and springs and configured to move the pacing roller between the stop position and the feed position, wherein each of the pins is connected to the respective spring so that the pacing roller carriage can move side to side within the frame;

a drive operably connected to the pacing roller carriage to move the pacing roller between the stop position and the feed position, wherein the drive is mounted to the pacing roller carriage by a universal joint.

8. The package pacer in accordance with claim 7 wherein the drive is a reciprocating cylinder mounted to the carriage opposite of the pacing roller relative to the pivot.

9. The package pacer in accordance with claim 7 including a sensor operably connected to the drive to sense the presence or absence of a package to generate a signal to move the pacing roller between the stop position and the feed position.

10. A strapping machine configured to feed a strapping material around a load, position, tension and seal the strapping material around the load, comprising:

a frame;

a strap chute around which strapping material is conveyed and from which strapping material is pulled position and tension the strapping material;

a driven in-feed belt conveyor, the in-feed conveyor defining an in-feed conveyor plane on which the load resides when the strapping material is positioned, tensioned and sealed around the load; and a package pacer having a pacer frame mountable to the frame; a plurality of rollers mounted to the pacer frame in a stationary plane about coplanar with the in-feed conveyor plane, the rollers extending forwardly of the strapping machine, the rollers configured to permit conveyance of the load therealong and onto the in-feed conveyor, a pacing roller movable between a stop position in which the pacer roller is out of the in-feed conveyor plane and interferes with movement of the package onto the plurality of rollers the in-feed conveyor and a feed position in which the pacing roller resides about coplanar with the plurality of rollers and the in-feed conveyor, a pacing roller carriage pivotally spring mounted to the pacer frame by a plurality of pins and springs and configured to move the pacing roller between the stop position and the feed position, wherein each of the pins is connected to the respective spring so that the pacing roller carriage can move side to side within the pacer frame, and a drive operably connected to the pacing roller carriage to move the pacing roller between the stop position and the feed position, the drive is mounted to the pacing roller carriage by a universal joint.

11. The packaging machine in accordance with claim 10 including a sensor operably connected to the drive to sense the presence or absence of a package to generate a signal to move the pacing roller between the stop position and the feed position.

* * * * *

UNITED STATES PATENT AND TRADEMARK OFFICE

CERTIFICATE OF CORRECTION

PATENT NO. : 7,270,054 B2
APPLICATION NO. : 11/306981
DATED : September 18, 2007
INVENTOR(S) : Bobren et al.

It is certified that error appears in the above-identified patent and that said Letters Patent is hereby corrected as shown below:

Claim 10, Line 6 should read:

-- and from which strapping material is pulled to position --

Claim 1, beginning with Line 21 should read:

-- package onto the plurality of rollers and the in-feed conveyor… --

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,270,054 B2
APPLICATION NO. : 11/306981
DATED : September 18, 2007
INVENTOR(S) : Bobren et al.

It is certified that error appears in the above-identified patent and that said Letters Patent is hereby corrected as shown below:

Column 6, line 11 should read

-- and from which strapping material is pulled to position --

Column 6, line 27 should read:

-- package onto the plurality of rollers and the in-feed conveyor… --

This certificate supersedes Certificate of Correction issued December 4, 2007.

Signed and Sealed this

Twenty-fifth Day of December, 2007

JON W. DUDAS
*Director of the United States Patent and Trademark Office*